United States Patent [19]

Coatsworth

[11] Patent Number: 4,949,766

[45] Date of Patent: Aug. 21, 1990

[54] POWDER FILLING MACHINE

[75] Inventor: Trevor Coatsworth, Barnard Castle, England

[73] Assignee: Glaxo Group Limited, London, England

[21] Appl. No.: 254,397

[22] Filed: Oct. 6, 1988

[30] Foreign Application Priority Data

Oct. 7, 1987 [GB] United Kingdom ..... 8723559

[51] Int. Cl.[5] ..... B65B 43/50

[52] U.S. Cl. ..... 141/67; 141/103; 141/71; 141/81; 141/144; 141/152; 141/145; 141/249; 222/636

[58] Field of Search ..... 141/67, 71, 81, 99, 141/100, 101, 102, 103, 129, 144, 145, 152, 168, 249, 266; 222/306, 636, 630, 637, 367, 368

[56] References Cited

U.S. PATENT DOCUMENTS

| | | | |
|---|---|---|---|
| 690,488 | 1/1902 | Valerius | 141/99 |
| 897,420 | 9/1908 | Small | 141/145 X |
| 1,778,216 | 10/1930 | Hansen | 141/145 |
| 1,828,167 | 10/1931 | Ayars | 141/144 |
| 2,907,357 | 10/1959 | Sandhage et al. | 141/59 |
| 3,410,377 | 11/1968 | Riedel et al. | 141/152 X |
| 3,565,132 | 2/1971 | Lefort | 141/147 |
| 3,626,997 | 12/1971 | Whitaker et al. | 141/100 X |
| 3,656,517 | 4/1972 | Taylor et al. | 141/67 x |
| 3,656,518 | 4/1972 | Aronson | 141/67 X |
| 3,847,191 | 11/1972 | Aronson | 141/67 X |
| 3,874,431 | 4/1975 | Aronson | 141/129 |
| 4,005,668 | 2/1977 | Washington et al. | 141/67 |
| 4,304,085 | 12/1981 | Ross | 141/103 |
| 4,509,568 | 4/1985 | Kawaguchi et al. | 141/129 |
| 4,640,448 | 2/1987 | Trechsel | 222/636 |
| 4,671,430 | 6/1987 | Dinius | 222/135 |
| 4,688,610 | 8/1987 | Campbell | 141/83 |
| 4,721,223 | 1/1988 | Jakobsen | 220/69 |
| 4,721,233 | 1/1988 | Asada | 222/245 |

FOREIGN PATENT DOCUMENTS

| | | | |
|---|---|---|---|
| 2534554 | 2/1977 | Fed. Rep. of Germany | 141/103 |
| 3120017 | 3/1982 | Fed. Rep. of Germany . | |
| 2094267 | 12/1984 | United Kingdom . | |

*Primary Examiner*—Ernest G. Cusick
*Attorney, Agent, or Firm*—Darby & Darby

[57] ABSTRACT

A machine for introducing a quantity of powder into a plurality of containers. The machine includes a powder transporting member, which has a plurality of downwardly open chambers, and a container transporting member located below the powder transporting member. The powder transporting member and the container transporting member are continuously rotated in unison about a substantially vertical axis. The machine includes a reservoir for powder with which the chambers communicate during part of the rotation of the powder transporting member. A vacuum is applied to the chambers to cause powder to be drawn therein. Powder from each chamber is discharged into a container carried by the container transporting member.

13 Claims, 6 Drawing Sheets

POWDER FILLING MACHINE

BACKGROUND OF THE INVENTION

This invention relates to a powder filling machine, by means of which a succession of containers receive a quantity of powder from a bulk supply thereof.

A known powder filling machine is shown diagrammatically in FIGS. 1 and 2 of the accompanying drawings, FIG. 1 being a side elevation and FIG. 2 being a vertical section showing the machine in a direction at right angles to FIG. 1.

The machine shown in FIGS. 1 and 2 comprises a filling wheel 2 rotatable about a horizontal axis by means of a horizontal shaft 4. The circumference of the filling wheel 2 has a plurality of radially extending ports 6, of which only two are shown in FIG. 2. Each port 6 has a piston 8 which, with the wall of the port 6, defines a chamber 10. The size of the chambers 10 can be altered by sliding the pistons 8 inwardly or outwardly in the ports 6. A hopper 12 is positioned immediately above the filling wheel 2 and contains a supply of powder. Below the filling wheel 2 is a conveyor mechanism, represented diagrammatically by line 14, which presents a succession of containers 16, of which one is illustrated, immediately beneath the filling wheel.

In use, a supply of powder is placed in the hopper 12 and is stirred throughout the process described below to maintain a homogeneous mix. The filling wheel 2 is rotated by the shaft 4 with an indexing motion. As each chamber 10 is positioned below the hopper 12 a predetermined volume of powder is drawn into the chamber to form a plug of powder therein, by the application of vacuum to the chamber. The means for applying vacuum are not shown. The amount of powder drawn in depends on the volume of the chamber which, in turn, depends on the position of the piston 8. The powder continues to be held in the chamber under vacuum until it reaches a position where it is vertically above the container 16 to be filled. At this point air, nitrogen or carbon dioxide, for example, at a little above atmospheric pressure is applied to the chamber to expel the powder into the container. The emptied chamber then continues its indexing motion back to the hopper. One modification of the system just described is to hold each container 16 in position below the filling wheel for long enough to receive a plurality of plugs of powder by discharge from a corresponding plurality of chambers. This makes it possible to use the same machine for filling containers with a wider range of fill weights or volumes. One use for the powder filling machine just described is in introducing pharmaceutical materials, for example ranitidine, into containers. The volume of such containers is typically from 8 ml to 127 ml, and the weight of powder to be introduced is in the range of from ¼ to 10 g or more, for example 350 or 450 mg, ideally in one shot.

The known machine just described uses, as has just been mentioned, a filling wheel which rotates with an indexing motion. This gives rise to a number of disadvantages. One of these is that the speed at which the wheel can rotate is necessarily much less than the speed at which it could rotate were it doing so continuously. As a consequence, the number of containers which can be filled per unit time is considerably less than the number which could be filled were the machine not rotating with an indexing motion. Also, the indexing motion requires a sophisticated timing mechanism to ensure that a container is correctly positioned with respect to a chamber at the moment when powder is being discharged from the chamber. The necessity for such a timing mechanism gives rise to the possibility of error, and in any case increases the cost of the machine.

Examples of such known filling machines are disclosed in U.S. Pat. No. 4,640,448 (TL Systems Corporation), German Published application No. 31 20 017 (Zanasi Nigris S.p.A.) and U.S. Pat. No. 4,671,430 (Eli Lilly and Company).

British Patent No. 2094267 B (IMA-Industria Macchine Automatiche SpA) describes a machine for feeding predetermined quantities of tea and the like onto a web of filter material to form tea bags. The tea is fed from a generally horizontal filling wheel having recesses which are filled with the tea by means of plungers.

U.S. Pat. No. 2,907,357 (American Cyanamid Company) discloses a powder filling machine for bottles wherein a powder measuring roll rotates about a horizontal axis and feeds powder to a funnel plate rotating about a vertical axis. The funnel plate comprises a plurality of funnels arranged above a plurality of bottles which are carried about an axis colinear with the funnel plate axis.

SUMMARY OF THE INVENTION

It is an object of the present invention, in at least some aspects thereof, to provide a machine which eliminates or mitigates the above disadvantages and can advantageously be used in sterile powder filling operations.

Accordingly, the present invention provides a machine for introducing a quantity of powder into a plurality of containers, comprising a powder transporting member having a plurality of downwardly open chambers, a container transporting member located below the powder transporting member, means for continuously rotating the powder transporting member and the container transporting member in unison about a substantially vertical axis, a reservoir for powder with which the said chambers communicate during part of the rotation of the powder transporting member, means for applying vacuum to the chambers to cause powder to be drawn therein, and means for discharging the powder from each chamber into a container carried by the container transporting member.

BRIEF DESCRIPTION OF THE DRAWINGS

Preferred embodiments of the present invention are described in detail below, by example only, with reference to the accompanying drawings, wherein.

DETAILED DESCRIPTION

Figure 3:
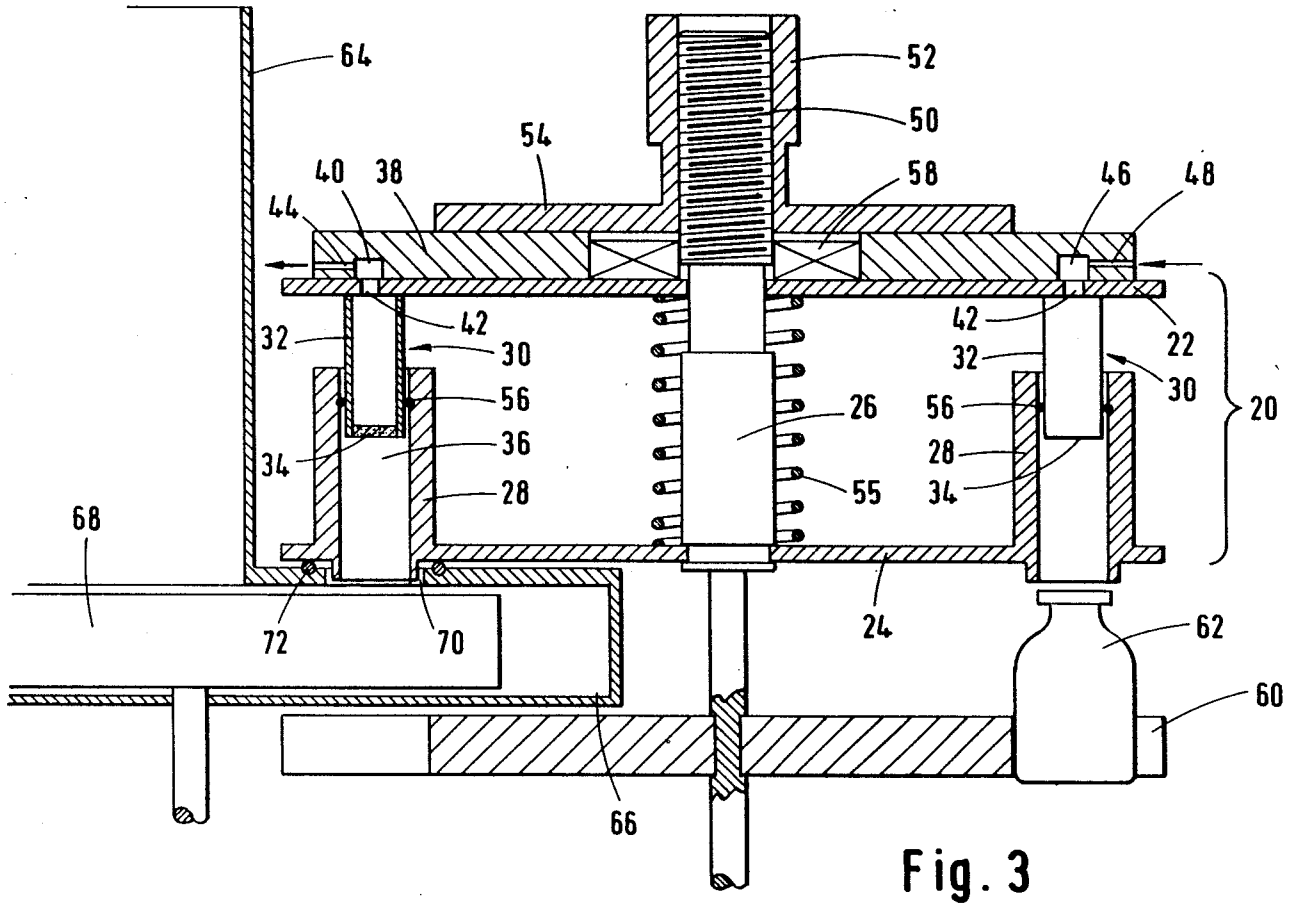
FIG. 3 is a diagrammatic vertical section showing an embodiment of the present invention.
Figure 4:
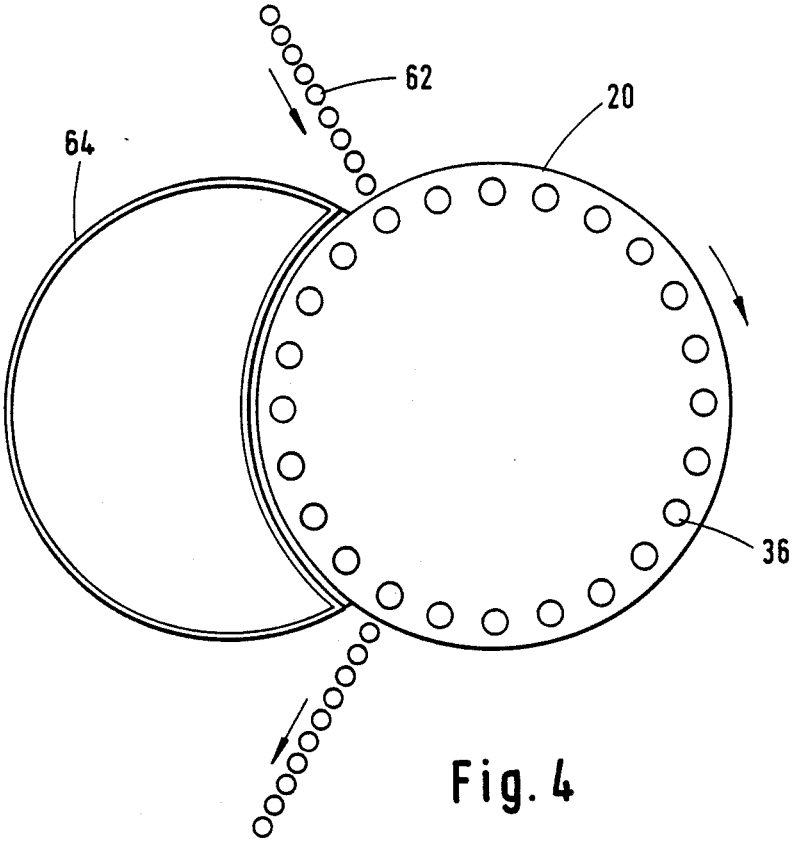
FIG. 4 is a horizontal section showing part of the machine of FIG. 3 and the powder reservoir.
Figure 5:
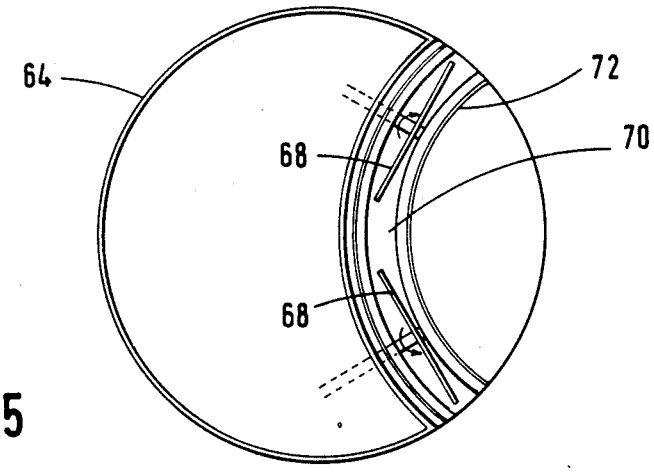
FIG. 5 is a similar view to FIG. 4, showing in detail the powder reservoir.

The embodiment shown in FIGS. 3 to 5 comprises a filling wheel 20 having an upper plate 22 and a lower plate 24 both secured to a shaft 26 for rotation by the shaft about a vertical axis. Adjacent its circumference the lower plate 24 carries a plurality of upstanding cylinders 28, and the upper plate 22 carries a corresponding plurality of downwardly extending pistons 30, each piston 30 being received within a respective cylinder 28. The pistons 30 each comprise a tube 32 made of a material such as stainless steel, closed at the lower end by a barrier 34 of sintered stainless steel, i.e. a material which is permeable to air but impermeable to powder. Alternatively, the barrier 34 may, for example, be made of nylon or a woven wire cloth. The space defined within each cylinder 28 below the barrier 34 constitutes a chamber 36 for receiving powder. In a preferred form of the wheel 20 there may be twenty-four chambers 36.

An annular plate 38 is mounted stationarily above the upper plate 22 in such a manner that the upper surface of the plate 22 is in sliding contact with the lower face of the plate 38. An arcuate channel 40 is formed in the lower surface of the plate 38 and is in communication via ports 42 in the upper plate 22 with the interior of those pistons 32 which are located below the arcuate channel 40. The channel 40 communicates via a bore 44 with a source of vacuum. The plate 38 has a further channel 46 which communicates via one of the ports 42 with the interior of one of the pistons 30. The extent of the channel 46 is such that at any given moment only one piston 30 is in communication with the channel 46. The channel 46 communicates via a bore 48 with a source of air at above atmospheric pressure.

The configuration of the channels 40 and 46 are described in more detail further on in the description.

The upper end of the shaft 26 carries a screw thread 50 on its outer surface, and this is in threaded engagement with a corresponding screw thread on the inner wall of an adjustment member 52. The member 52 has a lower annular portion 54 the lower surface of which is in sliding contact with the upper surface of the plate 38. By rotating the adjustment member 52 the plates 22 and 38 can be raised or lowered. This alters the relative positions of the cylinders 28 and pistons 30, thus altering the size of the chamber 36. A compression spring 55 urges the plates 22 and 24 away from one another. Whatever the position of each piston 30 with respect to its cylinder 28, air-tight contact therebetween is maintained by an O-ring seal 56. Rotation of the shaft 26 with respect to the stationary plate 38 is permitted by the provision of a ball race 58 or other bearing structure.

As an example, if the diameter of each chamber 36 is 10 mm, the length of the chamber may be adjustable between 3 mm and 40 mm.

Volumes of the chamber range from approximately 85 to 3142 $mm^3$ (i.e. lengths of from 3 mm to 40 mm if the diameter is 10 mm). Preferably the volumes of the chamber range approximately up to 1571 $mm^3$ (i.e. lengths approx 3 mm to 20 mm if the diameter is 10 mm).

A container transporting member in the form of a magazine 60 is located below the wheel 20. The magazine takes the form of a generally circular disc which is secured to a continuation of the shaft 26 for rotation therewith. Thus, wheel 20 and magazine 60 rotate in unison with one another. The magazine 60 carries, in use, a plurality of vials 62 or other containers in notches around its circumference. Empty vials are brought to the magazine by a conventional conveyor, for example a scroll conveyor, so that each vial is located immediately beneath a respective chamber 36. As the wheel 20 and the magazine 60 rotate in unison with one another the vials continue to be located beneath their respective chambers until the filling process, described below, is completed, at which point the vials are removed from the magazine by another conveyor (not shown) which may also be of a conventional construction.

The feeding of the vials 62 to and from the wheel 20 is shown in FIG. 4. The vials 62 rotate with the filling wheel around approximately 240° before being removed, having been filled with powder.

Figure 6:
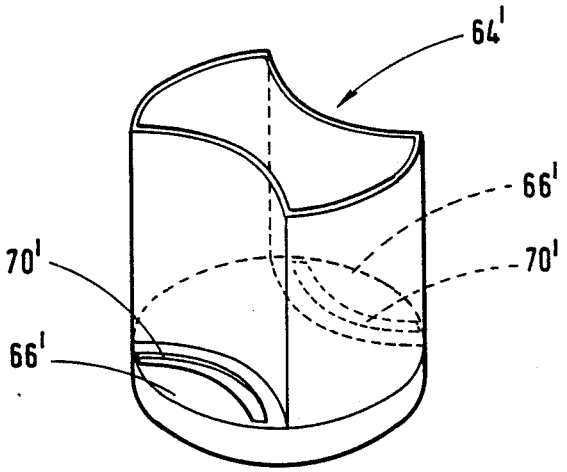
FIG. 6 is a perspective view of a hopper which can serve two filling wheels.

A powder reservoir is provided in the form of a hopper 64 which is located to one side of the structure described thus far. If desired, the structure described above may be duplicated on the opposite side of the powder hopper 64, so that a single hopper serves two filling wheels. This effectively doubles the capacity of the machine. A hopper 64' appropriate for serving two filling wheels is shown in FIG. 6. The hopper 64 has a foot portion 66 of larger diameter than its body portion, the portion 66 extending below part of the wheel 20. In the case of hopper 64' two portions 66' are provided, on diametrically opposite sides of the hopper.

Stirrer paddles 68, shown by way of example in FIG. 5 as being cruciform in shape, rotate in the hopper portion 66 to maintain a homogeneous powder mix therein.

The hopper portion 66 has an arcuate opening 70 so located that at least one of the chambers 36 is in communication at any given time with the interior of the hopper. The hopper 64' has two arcuate openings 70'. Preferably a plurality of chambers 36 are simultaneously in communication with the interior of the hopper, and FIG. 4 shows by way of example a situation where seven such chambers are in communication. To prevent a leakage of powder from the chambers 36 while they are in communication with the interior of the hopper, a seal 72 surrounds the opening 70, and the lower surface of the wheel 20 is in sliding contact with the seal 72. In order to reduce wear on the lower plate 24 at least the portion thereof in contact with the seal 72 is coated with a suitable material such as stainless steel impregnated with polytetrafluoroethylene. The ends of the opening 70 are sealed by conventional doctor blades (not shown).

In use, the shaft 26 is continuously rotated at a constant speed and as chambers 36 come above the opening 70 the vacuum applied to the channel 40 causes powder to be drawn into the chambers. Vacuum continues to be applied after the chambers are no longer above the opening 70, so as to hold in each of the chambers a plug of powder. As each chamber passes below the channel 46 in the plate 38, vacuum ceases to be applied and instead air, nitrogen or carbon dioxide, for example, at above atmospheric pressure enters the chamber. This causes the plug of powder in the chamber to be discharged into the vial 62 located below the chamber. If desired, means (not shown) may be provided for discharging air into each chamber after a plug of powder has been discharged therefrom. This serves to clean the chamber. A vacuum extraction system is then preferably provided to collect any powder blown out of the chambers.

Figure 1:
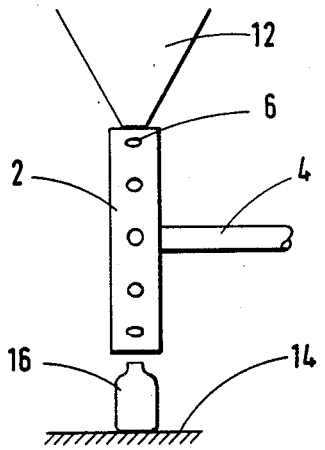
Fig. 1 PRIOR ART
FIGS. 1 and 2 are views showing a known powder filling machine, as already described.
Figure 2:
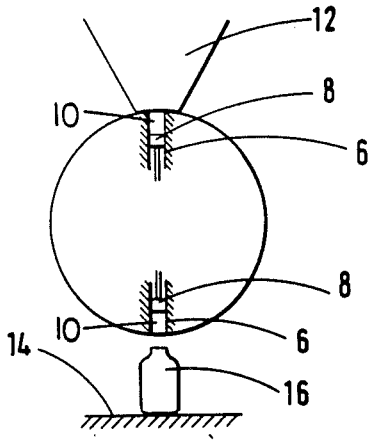
Fig. 2 PRIOR ART

It will be appreciated that as the wheel 20 is rotated continuously and at a constant speed the number of containers filled per unit time can be greater than with the conventional machine described above with reference to FIGS. 1 and 2 where the filling wheel is indexed. Thus, the invention can provide for operating speeds of from 25 to 500 vials per minute. Furthermore, the need for a sophisticated timing mechanism is eliminated. Each container is transported in alignment with a respective chamber so that the precise moment at which powder is discharged from the chamber is not critical. It should also be noted that the use of an arcuate opening 70 enables each chamber to be in communication with the hopper for a substantial period of time, thus ensuring that each chamber is completely filled. This is particularly important where the machine is being used for application such as in the pharmaceutical field, where it is important to achieve a constant and predetermined dose of powder in each container. It should be noted that though the speed at which the machine operates is preferably constant, this speed can be adjusted to meet different filling demands.

Figure 7:
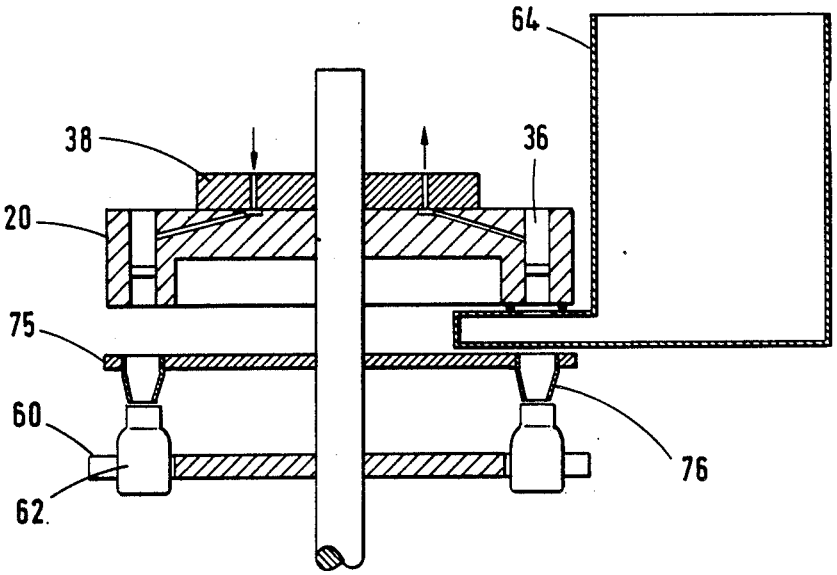
FIG. 7 is a diagrammatic vertical section showing another embodiment of the invention.

It may be desired to use the machine of the present invention to introduce into a container a larger quantity of powder than can be conveniently transferred direct into the container. An embodiment in which this is achieved is illustrated in FIG. 7. A vibratory transfer magazine 75 is arranged between the filling wheel 20 and the vials 62, so that a dose from a large chamber 36 in the wheel 20 is introduced into an intermediate funnel-shaped container 76 or transfer member carried by the magazine 75 and the contents of the intermediate container 76 then discharged into the vial 62. The magazine 75 is rotated in unison with the wheel 20 and vial magazine 60 and is vibrated as it turns by means of a conventional vibratory bearing (not shown).

Figure 8:
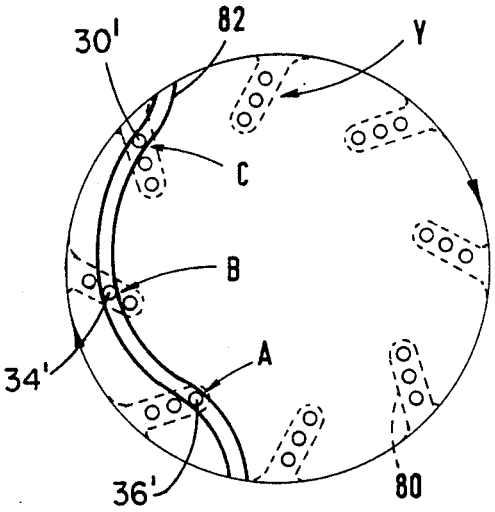
FIGS. 8 and 9 show respectively two filling wheels which may be used in a further embodiment of the invention.
Figure 9:
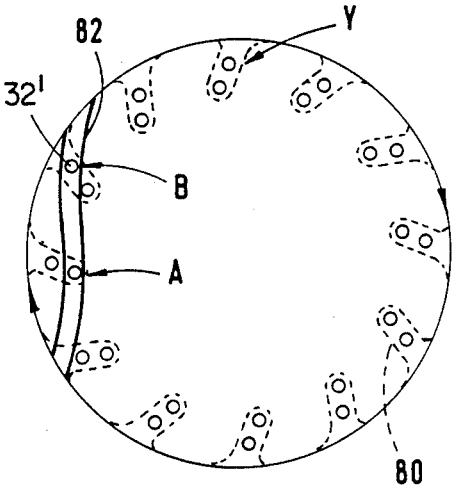

An alternative way of introducing large doses into vials is provided by the embodiments which are shown in FIGS. 8 and 9. In these embodiments each chamber 36 is replaced by a set of several chambers 30', 34'. FIG. 8 shows sets of three chambers 32', and FIG. 9 shows sets of two chamber 36'. As illustrated, in each set the chambers are disposed along a line which is at an acute angle to a radius, though they may alternatively be disposed along a radius. The magazine carries each vial 62 in an elongate slot 80 which is indicated by broken lines in FIGS. 8 and 9. The slots 80 are arranged at the same angle to a radius as are the rows of chambers 36' so that the vial in each slot can register with one of the chambers.

Each vial is fed to the magazine 60 and initially adopts the radially innermost position, indicated by reference A in FIG. 8. As the filling wheel rotates a first plug of powder is discharged from the radially innermost chamber 36' in the set of three into the vial. A stationary curved guide rail 82 is provided which, as the filling wheel and magazine continue to rotate, guides the vial outwardly along slot 80. It will be seen that when the vial reaches position B a second plug of powder can be discharged into it from a second chamber 34' in the set of three. Upon continued rotation of the magazine 60 the rail 82 guides the vial into position C, in which a third plug of powder is discharged from a third chamber 30'.

Plugs of powder are introduced simultaneously into three vials in three different slots 80, since when one vial is at position A another has reached position B (having already received one plug of powder at position A) and another is at position C having already received plugs of powder at positions A and B. If provision is made, as mentioned above, for introducing air into the chambers to clean them, this may be done at the location indicated by Y.

The procedure with the filling wheel of FIG. 9 is the same as the procedure with the filling wheel of FIG. 8, except that only two plugs of powder are discharged into each vial.

The configuration of the channels 40 and 46 in the top plates 38 of the filling machine described in relation to FIGS. 3, 8 and 9 will now be considered in detail. Plan views of the relevant plates 38 are shown in FIGS. 10, 11 and 12 respectively.

Figure 10:
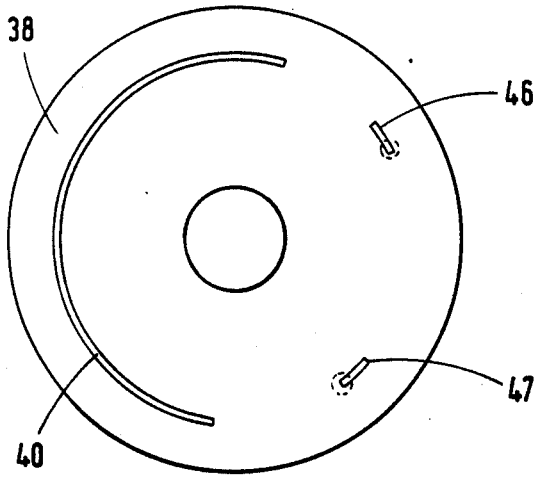
FIGS. 10 to 12 are plan views showing details of the embodiments of FIGS. 3, 9 and 10.

As shown in FIG. 10, the plate 38 for the embodiment of FIG. 3 has an arcuate channel 40 extending around approximately 180°. As discussed above, the channel 40 communicates with a source of vacuum. As the filling wheel 20 and magazine 60 rotate, chambers 36 are continuously coming into and out of communication with the channel 40. While in communication with the channel, the chambers are filled with powder from the hopper 64 arranged below. Shortly after coming out of communication with the channel 40, the chambers in turn communicate with the channel 46 which causes the powder to be discharged into the vial 62 below the chamber which has been rotating in unison therewith. Further rotation brings each chamber in turn into communication with a port cleaning slot 47, the function of which has been explained above.

Figure 11:
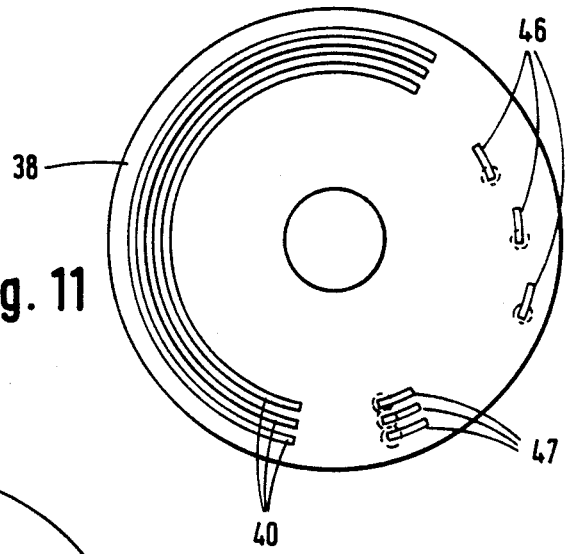
Figure 12:
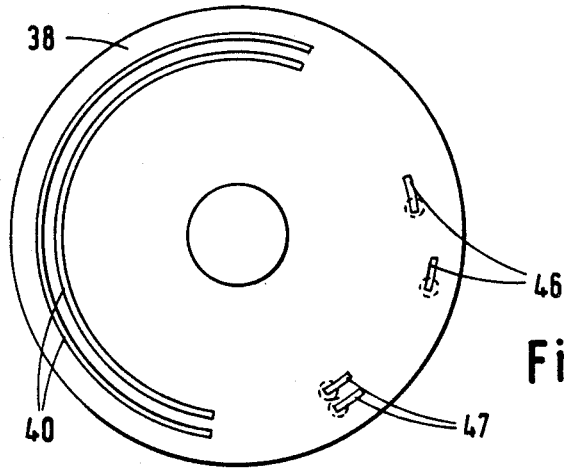

As shown in FIGS. 11 and 12, the configuration of the channels 40 and 46 for the embodiments of FIGS. 8 and 9 is similar to that shown in FIG. 10, except that three and two sets of channels respectively are provided for communication with the sets of three and two chambers 36'. The air discharge channels 46 are staggered around the circumference so that at a given moment powder is being discharged into three vials 62 in the positions A, B and C, taking FIG. 8 as an example.

The appropriate number of port cleaning slots 47 are also provided.

Figure 13:
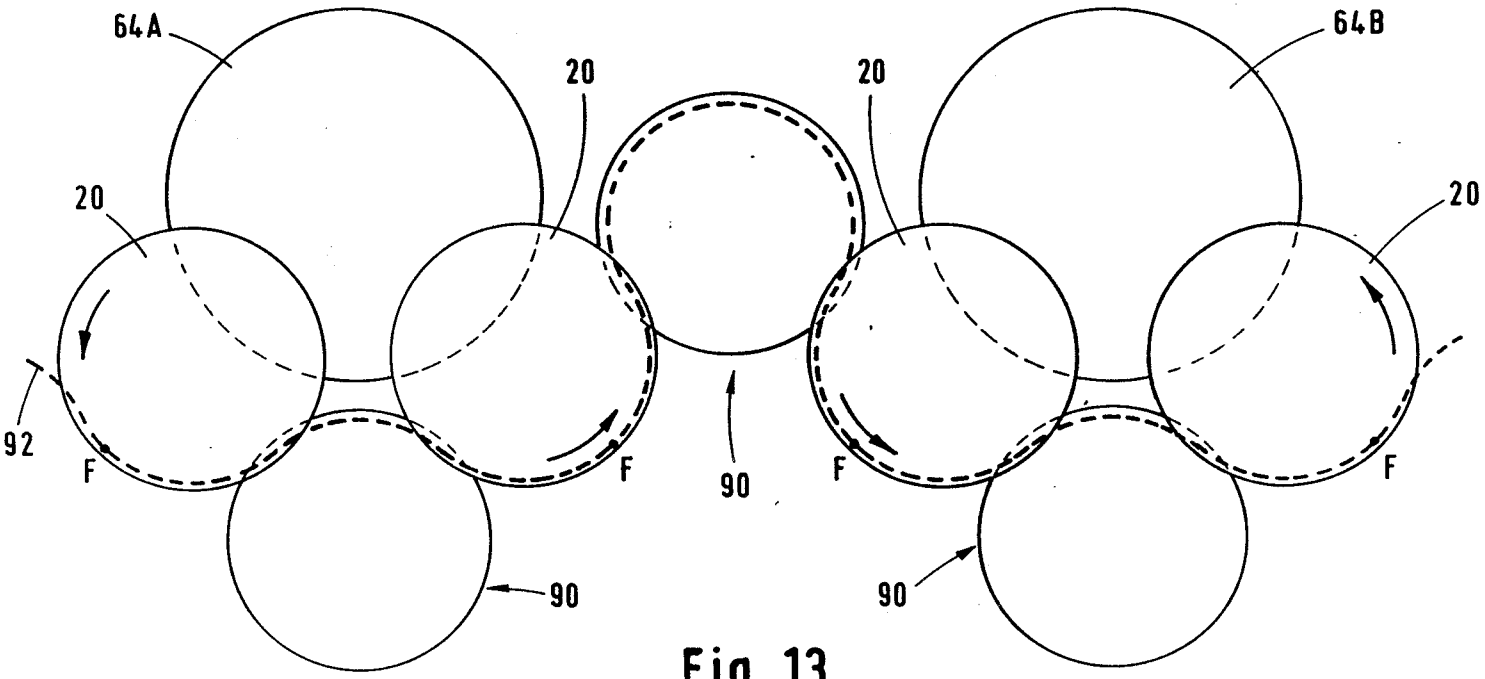
FIG. 13 is a diagrammatic plan view of a further embodiment of the invention.

In a further embodiment of the invention, which provides another way of introducing a larger or varied dose of powder into a vial, a plurality of filling wheels (say two or three) is provided, each receiving powder from the same hopper, or different hoppers, with the vials passing successively from one filling wheel to the next to receive a dose of powder from each. An example of such an embodiment is illustrated FIG. 13.

The figure shows two hoppers 64A, 64B each feeding two filling wheels 20. Vials are passed between the filling wheels by rotating vial transfer magazines 90. The path of the vials is shown by the dashed line 92. The dosing position for each wheel 20 is indicated by the letter F.

Each vial thus receives four doses of powder in total, two from hopper 64A and two from hopper 64B. The material A in the first hopper may be the same as or different from the material B in the second hopper.

I claim:

1. A machine for introducing a quantity of powder into a plurality of containers, comprising a powder transporting member having a plurality of downwardly open chambers, a container transporting member located below the powder transporting member, means for continuously rotating the powder transporting member and the container transporting member in unison about a common and substantially vertical axis, a reservoir for powder with which the said chambers communicate during part of the rotation of the powder transporting member, means for applying vacuum to the chambers to cause powder to be drawn therein, and means for discharging the powder from each chamber into a container carried by the container transporting member.

2. A machine according to claim 1, wherein the reservoir is located, at least in part, between the powder transporting member and the container transporting member.

3. A machine according to claim 2, wherein a plurality of the chambers are in communication with the reservoir at any given moment.

4. A machine according to claim 1, further comprising a transfer member arranged between the powder transporting member and the container transporting member to aid transfer of the powder from the chambers to the containers.

5. A machine according to claim 4, further comprising means to vibrate the transfer member.

6. A machine according to claim 1, wherein the powder transporting member comprises a plurality of sets of at least two chambers, and wherein means are provided for successively locating each container under a different chamber of each set as the transporting members are rotated.

7. A machine according to claim 6, wherein the said locating means comprises a fixed guide rail and wherein the container transporting member comprises a plurality of slots along which the containers are guided by the said rail during rotation.

8. A machine according to claim 1, wherein the volume of each chamber is adjustable between 85 and 3142 $mm^3$.

9. A machine according to claim 1, comprising twenty-four of the said chambers.

10. A machine according to claim 1 in combination with another machine, wherein the machines communicate with a common reservoir for powder and are separated from each other and free of one being radially inside the other.

11. A machine in combination with another machine according to claim 10 to constitute a pair of machines and in further combination with another pair of machines so that there are at least two pairs of machines, wherein each of said pairs of machines has a common powder reservoir.

12. A machine according to claim 1 in combination with another machine, further comprising means for transferring containers from the container transporting member of one machine to a container transporting member of the other machine, said machine being separated from each other and free of one being radially inside of the other.

13. A machine as in claim 1, wherein said continuously rotating means rotates so that as many as 25 to 500 containers may be filled each minute.

* * * * *